United States Patent [19]

Dubbelman

[11] Patent Number: 4,770,224

[45] Date of Patent: Sep. 13, 1988

[54] POWER OPERATED INDUSTRIAL DOOR

[75] Inventor: Voldeman Dubbelman, Orebro, Sweden

[73] Assignee: Kelley Company, Inc., Milwaukee, Wis.

[21] Appl. No.: 140,941

[22] Filed: Dec. 24, 1987

Related U.S. Application Data

[63] Continuation of Ser. No. 875,632, Jun. 18, 1986, abandoned, which is a continuation-in-part of Ser. No. 674,983, Nov. 26, 1984, abandoned.

[51] Int. Cl.[4] ..... A47H 5/02

[52] U.S. Cl. ..... 160/331; 160/126; 160/349.1

[58] Field of Search ..... 160/331, 345, 346, 347, 160/348, 349 R, 349 D, 344, 126, 123, 84 R; 16/87.4 R, 87.6 R, 87.8, 94 R, 94 D, 95 R, 95 D, 96 R, 96 D

[56] References Cited

U.S. PATENT DOCUMENTS

| | | | |
|---|---|---|---|
| 1,831,128 | 11/1931 | McKenny et al. | 160/331 |
| 2,161,382 | 6/1939 | Raapke | 156/21 |
| 2,321,491 | 6/1943 | Keys et al. | 160/126 |
| 2,653,656 | 9/1953 | Kuebler | 16/87.6 R X |
| 2,753,588 | 7/1956 | Grosh | 16/95 D |
| 3,004,769 | 10/1961 | Turner | 280/150 |
| 3,016,951 | 1/1962 | Greene | 160/126 |
| 3,194,298 | 7/1965 | Sussin | 160/35 |
| 3,372,599 | 3/1968 | Bratschi | 74/89.2 |
| 3,481,073 | 12/1969 | Yoshida et al. | 160/84 R X |
| 3,636,588 | 1/1972 | Ferris | 16/94 |
| 3,672,425 | 6/1972 | Schulz-Robbecke | 160/331 |
| 3,818,544 | 6/1974 | Helmer et al. | 16/94 D |
| 3,823,439 | 7/1974 | Selset | 16/94 D |
| 3,861,738 | 1/1975 | Whitney | 296/138 |
| 4,142,570 | 3/1979 | Heimberg | 160/349 |
| 4,230,171 | 10/1980 | Baker | 160/345 X |
| 4,254,815 | 3/1981 | Comeau | 160/126 |
| 4,342,355 | 8/1982 | Geller et al. | 160/331 |
| 4,548,250 | 10/1985 | Meharg et al. | 160/331 |
| 4,581,788 | 4/1986 | Baumann | 16/94 D |

FOREIGN PATENT DOCUMENTS 435409 3/1987 Sweden .

OTHER PUBLICATIONS

Skjutport typ PT-20, Portteknik, Sweden (Along with English Translation).

*Primary Examiner*—Ramon S. Britts
*Assistant Examiner*—David M. Purol
*Attorney, Agent, or Firm*—Andrus, Sceales, Starke & Sawall

[57] ABSTRACT

A power operated industrial door to enclose a doorway in a building. The door comprises a pair of flexible curtains, one vertical side edge of each curtain being secured to the building adjacent the doorway, while the upper horizontal edge of each curtain is attached to a plurality of trolleys that are mounted for movement on tracks disposed above the doorway. One trolley associated with each curtain is secured to an endless drive cable, while the remaining trolleys are freely mounted on the cable so that operation of the cable will move the curtain between open and closed overlapping positions. The upper edge of each curtain is connected to the trolley in a manner such that the curtain will be uniformly folded when moved to the closed position. Weights, in the form of metal shot, can be positioned in elongated pockets along the movable vertical side edge of each curtain, as well as at the bottom of the curtain to aid in resisting wind loads.

16 Claims, 5 Drawing Sheets

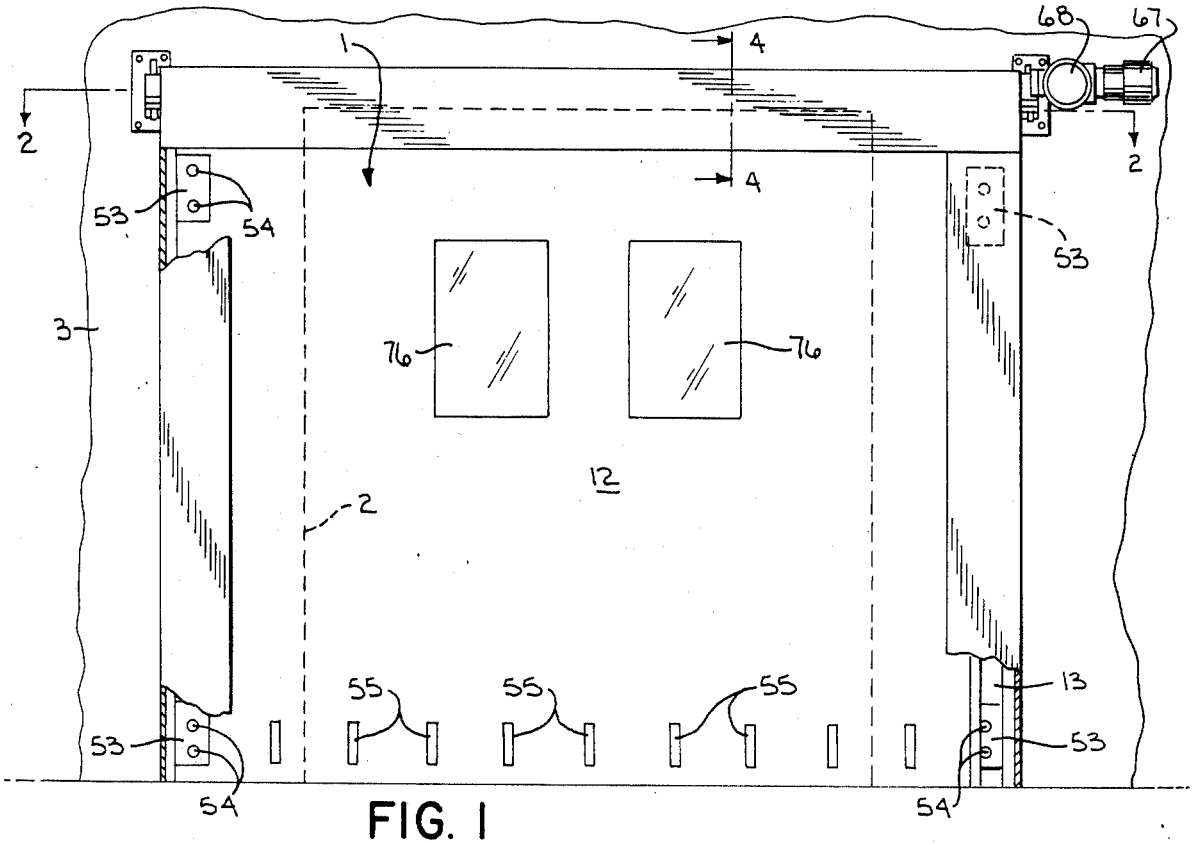
FIG. 1
FIG. 4
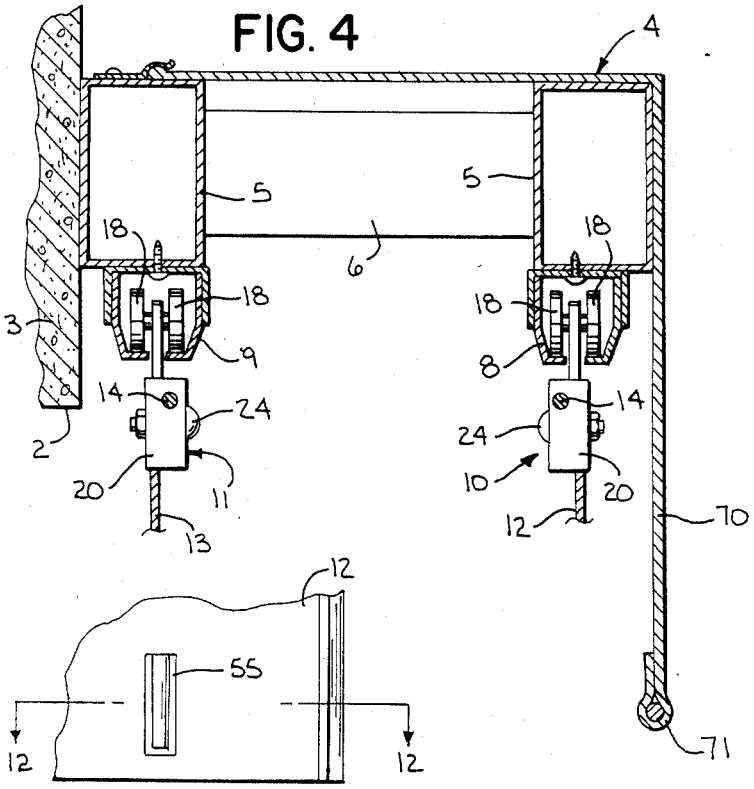
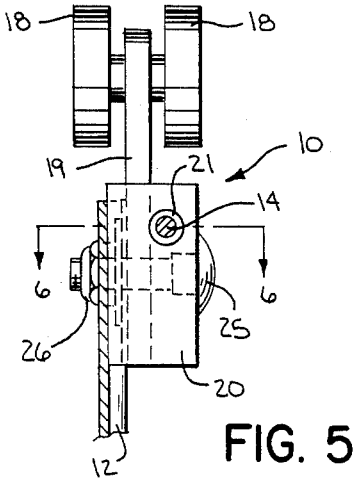
FIG. 5
FIG. 6
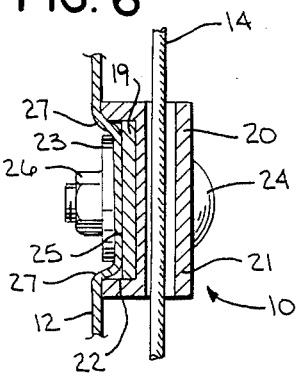
FIG. 11
FIG. 12
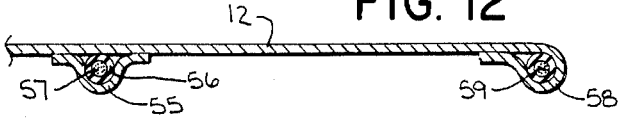

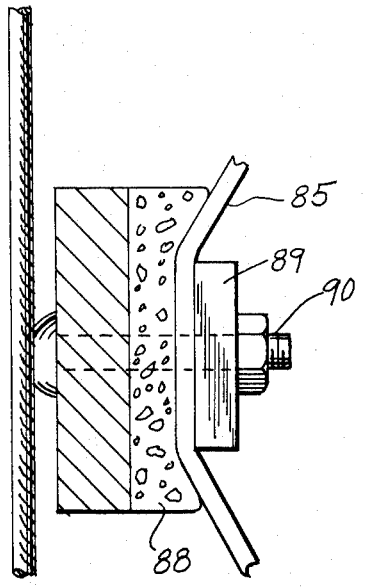
FIG. 15
FIG. 16
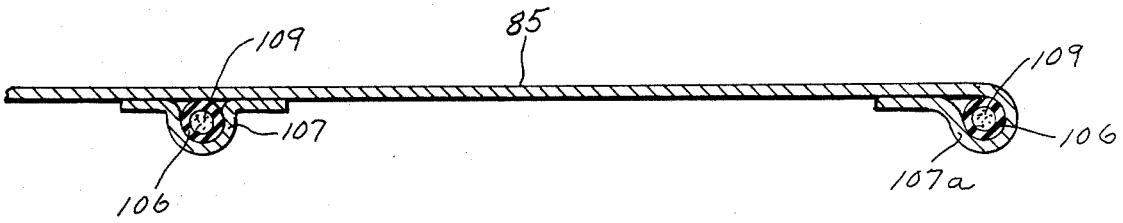
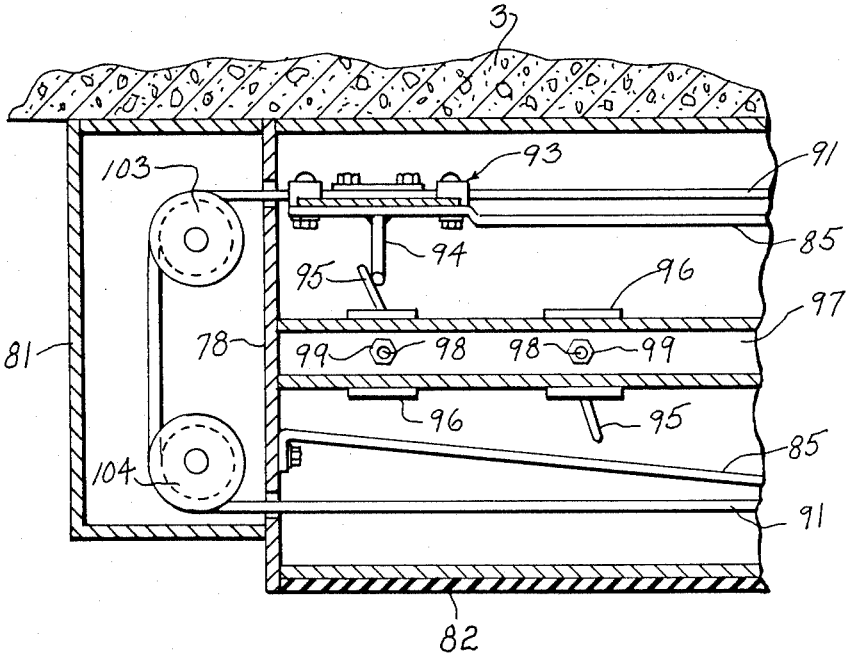
FIG. 17

POWER OPERATED INDUSTRIAL DOOR

This is a continuation of application Ser. No. 06/875,632, filed June 18, 1986, now abandoned, which is a continuation-in-part of application Ser. No. 06/674,983, filed Nov. 26, 1984, now abandoned.

BACKGROUND OF THE INVENTION

In industrial buildings and warehouses it is often desired to have a door or closure to separate two areas of the building which are subjected to different ambient conditions, or to separate the inside of the building from the outside. The door should be capable of quickly moving between a closed and open position, so that material handling equipment, such as a fork lift truck, can move through the doorway without delay. Fast movement between the open and closed positions also benefits in minimizing energy losses.

In order for the door to move at high speed it should be lightweight, and yet capable of handling pressure differentials and wind loads, without undue deflection.

As a further requirement, the door should be durable and capable of yielding to impact by material handling equipment so as to prevent damage to the door or to the material handling equipment or to personnel.

SUMMARY OF THE INVENTION

The invention is directed to a power operated industrial door and more particularly to an industrial door whigh includes a pair of flexible panels or curtains that can be moved between a closed and open position. In accordance with the invention, one vertical side edge of each curtain is secured to the building adjacent the doorway, while the upper edge of each curtain is connected to a plurality of trolleys that are mounted for movement on a horizontal track located above the doorway. One trolley associated with each curtain is secured to an endless drive cable, while the remaining trolleys are freely mounted on the cable. Through operation of the cable, the curtain can be moved between the open and closed positions.

The upper edge of each curtain is clamped to the trolley in a manner such that the curtain will be uniformly folded when moved to the open position.

The door also includes a novel drive mechanism in whigh the endless cable is driven by a double grooved drive pulley. The cable is trained over the double grooved drive pulley and over an adjacent tensioning pulley. The double groove provides increased contact area between the cable and the pulley to increase the frictional resistance, and yet the cable is capable of slipping relative to the pulley, if the door should meet an obstruction whigh prevents it from moving.

To further aid in resisting wind loads, weights can be applied to each curtain along the movable vertical edge and along the bottom edge. In this regard, the curtain is formed with vertical elongated pockets that receive tubular members or hoses containing metal shot or similarly dense material. The use of the hoses with metal shot provides a convenient manner of applying the necessary weight to the curtain to resist wind deflection.

The curtain door of the invention is lightweight and is capable of being moved at high speeds between the open and closed position. While most industrial doors will move at a speed of 0.15 to 0.50 meters per second, the door of the invention is capable of speeds up to 1.5 meters per second.

As the curtains are fabricated of flexible plastic material they will withstand impact by material handling equipment without damage and, similarly, will not impart damage to the material handling equipment or personnel.

In a preferred form of the invention, each curtain has a width sufficient to enclose the doorway, so when in the closed position, the curtains will fully overlap. As each curtain is supported along one vertical edge and is secured at the top of the other vertical edge, the curtain is stretched diagonally when in the closed position. This diagonal stretching of the overlapped curtains aids in preventing deflection of the curtains under wind loads or pressure differentials.

In the closed condition there is an air space of several inches between the curtains whigh provides a natural insulating pocket to reduce heat transfer between the environments.

It is also contemplated that in other installations the curtain may have a width slightly greater than one-half the width of the doorway, in whigh case the curtains, when in the closed position, will overlap only at the center of the doorway.

The curtain door of the invention can be used for either indoor or outdoor use to separate areas of different temperature or environmental atmospheres.

In a modified form of the invention, a series of flexible tubes are secured in spaced relation along the width of each curtain. Each tube extends the full height of the curtain and is filled with a finely divided weighted material, such as shot. The tubes act as battans to stiffen the curtains and provide increased wind resistance to prevent deflection.

The door of the invention also incorporates an extruded metal header whigh is mounted on the outer surface of the building over the doorway. The header incorporates a pair of spaced guide tracks within whigh the trolleys ride that are attached to the upper edge of the res ective curtains. In addition, the extruded header includes a central channel located between the guide tracks and a pair of limit switch assemblies that control the opening and closing of the curtains are adjustably mounted in the central channel.

Other objects and advantages will appear in the course of the following description.

DESCRIPTION OF THE DRAWINGS

The drawings illustrate the best mode presently contemplated of carrying out the invention.

In the drawings:

FIG. 1 is a front elevation of the curtain door of the invention;

FIG. 4 is a vertical section showing the connection of the curtains to the tracks by means of the trolleys;

FIG. 5 is an enlarged side elevation of a trolley;

FIG. 6 is a section taken along line 5—5 of FIG. 5;

FIG. 11 is a fragmentary enlarged front elevation showing the attachment of weights to the curtain;

FIG. 12 is a section taken along line 12—12 of FIG. 11;

FIG. 15 is a section taken along line 15—15 of FIG. 14;

FIG. 16 is a section taken along line 16—16 of FIG. 13; and

FIG. 17 is a fragmentary horizontal section showing a portion of the cable drive mechanism with the curtains in the closed position.

DESCRIPTION OF THE ILLUSTRATE EMBODIMENT

Figure 2:
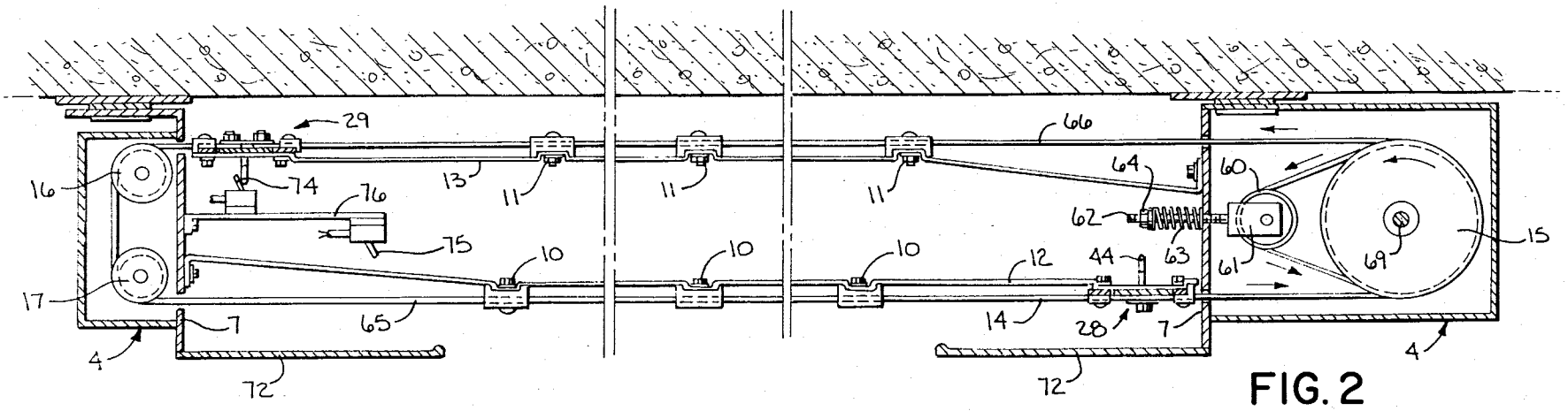
FIG. 2 is a horizontal section showing the endless cable drive mechanism and the curtains in the closed position.

FIG. 1 shows an industrial curtain door 1 which is adapted to enclose a doorway 2 in building 3.

Door 1 includes an upper frame 4 whigh is mounted to the building 3 above doorway 2, and frame 4 includes a pair of horizontal generally rectangular beams 5 whigh are connected together by a series of cross beams 6. End plates 7 are connected to the respective ends of beams 5.

As best shown in FIG. 4, beams 5 carry tracks 8 and 9 and a plurality of trolleys 10 are adapted to ride on tracks 8, while a plurality of trolleys 11, similar in construction to trolleys 10, are mounted to ride on track 9.

A flexible curtain 12 is supported from the trolleys 10, and a similar curtain 13, is supported from the trolleys 11. Curtains 12 and 13 are preferably fabricated from plastic material, such as polyester fabric coated with plasticized polyvinylchloride.

Curtains 12 and 13 are adapted to be moved between a folded open position, in whigh each curtain is disposed adjacent the side of doorway 2, to a closed position in whch each curtain extends completely across the doorway and is in overlapping relation with the other curtain. Curtains 12 and 13 are moved between the open and closed positions by an endless drive cable 14, whigh is trained over a horizontal drive pulley 15 mounted on one end of frame 4, and a pair of idler pulleys 16 and 17 whigh are mounted for rotation on the opoosite end of frame 4.

The trolleys 10 and 11 whigh serve to support the respective curtains are identical in construction and, therefore, only the construction of trolley 10 is described, it being understood that the construction of trolley 11 will be the same.

Each trolley 10 includes a pair of rollers 18 whigh are supported for rotation on the upper end of a vertical bar 19 and ride on track 8. Block 20 is secured to the lower portion of bar 19 and contains a horizontal hole or passage 21 through whigh cable 14 freely passes.

As best shown in FIG. 6, block 20 is provided with a vertical recess 22 whigh receives bar 19. Curtain 12 is secured against the outer surface of bar 19 by a generally square washer 23. Bolt 24 extends through a reinforced eye 25 in curtain 12 and through aligned openings in block 20, bar 19, and washer 23. The outer end of bolt 24 receives nut 26. With the nut 26 tightened down, the curtain will be clamped to the block 20 in a generally U-shaped configuration. This configuration insures that when the curtain is moved to the open position, the curtain will fold up along the junctures 27 to thereby provide uniform convolutions or folds.

The upper ends of the free or movable vertical edges of curtains 12 and 13 are secured to the cable 14 by connectors 28 and 29, respectively. Connector 28, best shown in FIGS. 6 and 7, serves to connect the curtain 12 to cable 14. Connector 28 includes two pair of rollers 30 whigh ride on track 8 and each pair of rollers is journalled on the upper end of a bar 31. The lower ends of bars 31 are connected together by a plate 32. Stud 33 is welded to the connecting plate 32 and is provided with a transverse hole 34 whigh receives cable 14. Cable 14 is clamped against connecting plate 32 by washer 35 and nut 36 whigh is threaded on the end of stud 33. By turning down nut 36, the cable will be securely clamped against the connecting plate 32, so that connector 28 will move in accordance with movement of cable 14.

Connector 28 also includes a pair of trolley blocks 37 similar to blocks 20, previously described. Each block 37 has a horizontal hole or opening 38 to receive cable 14. In addition, each block 37 is provided with a vertical recess 39, similar to recess 22, whigh receives bar 31. Curtain 12 is secured against the face of bar 31 by a washer, not shown, and bolt 42 whigh receives nut 43. As previously described, the curtain 12 is thus clamped in a generally U-shaped configuration to the trolley block 37 whigh insures that the curtain will be uniformly folded when it is moved to the open position.

Movement of cable 14 in opposite directions will correspondingly move connector 28 to pull the curtain between the open and closed positions, and trolleys 10 will merely slide on the cable as the curtain is folded and unfolded.

Figure 7:
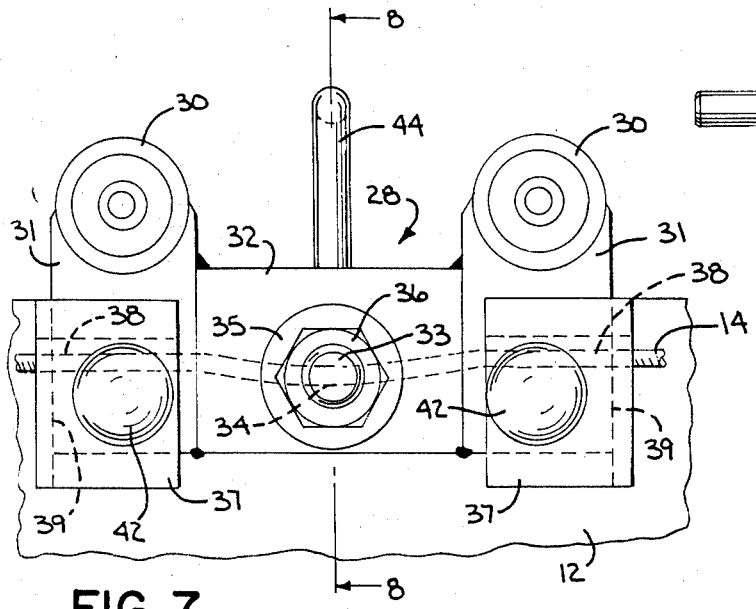
FIG. 7 is a side elevation of a connector.
Figure 8:
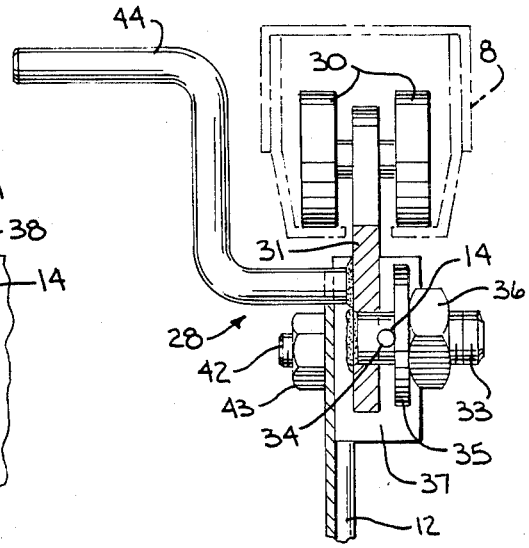
FIG. 8 is a section taken along line 8—8 of FIG. 7.

As best illustrated in FIG. 7, a generally S-shaped arm 44 extends laterally from the connecting plate 32 and serves to actuate a limit switch, as will hereinafter be described.

Figure 9:
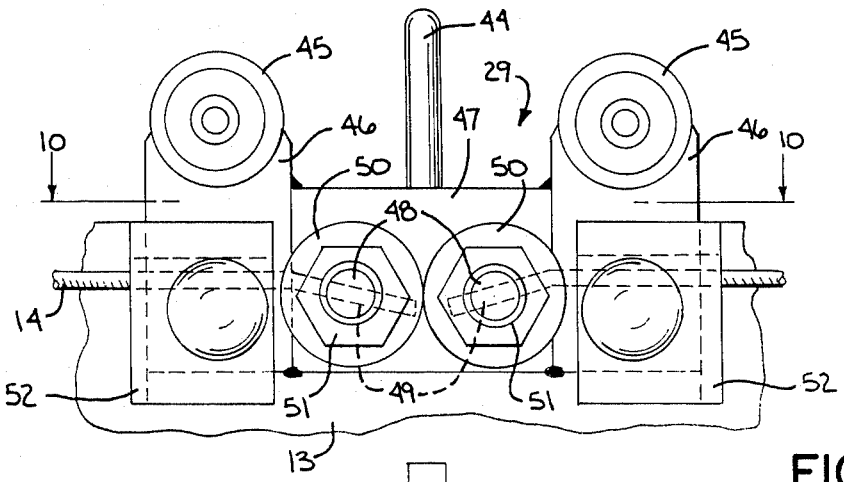
FIG. 9 is a side elevation of a connector for connecting the two free ends of the cable together.
Figure 10:
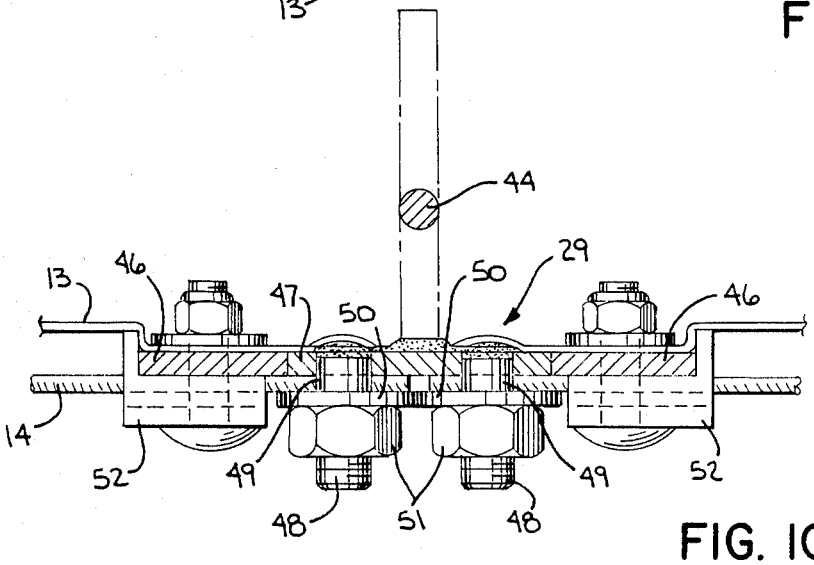
FIG. 10 is a section taken along line 10—10 of FIG. 9.

Connector 29 serves to connect the ends of cable 14 to curtain 13 and the construction of the connector 29 is best illustrated in FIGS. 9 and 10. Connector 29 includes two pair of rollers 45, each pair being journalled on the upper end of a vertical bar 46. The lower ends of bars 46 are connected together by a horizontal connecting plate 47.

A pair of studs 48 are welded to one face of plate 47 and each stud is provided with a transverse hole 49 whigh receives the respective end of cable 14. As previously described, the ends of cable 14 are secured or clamped against plate 47 by washers 50 and nuts 51 whigh are threaded on the respective studs 48.

In addition, connector 29 includes a pair of trolley blocks 52, whigh are similar in construction to blocks 37 and 20 previously described, and a switch actuating arm 44 extends laterally from the connector 29.

With this construction, movement of the endless cable 14 will correspondingly move connector 29 to move the curtain 13 between the open and closed positions.

One vertical side edge of each curtain 12 and 13 is secured to building 3, adjacent doorway 2. To provide this attachment, a pair of connecting plates 53 are mounted on the face of building 3 along each side of the doorway and suitable fasteners 54, such as screws, extend through eyes in the folded side edge of the respective curtains and are secured to the mounting plates 53. Thus, the upper and lower end of one vertical side edge of each curtain is secured to the building, while the opposite vertical side edge is movable across the doorway to the closed position through operation of the cable 14.

To aid in resisting wind loads and pressure differentials on opposite sides of the door, weights can be applied to the lower portion of each curtain 12 and 13. As best shown in FIGS. 11 and 12, each curtain can be provided with a series of vertically extending pockets 55 each having an open upper end and a closed lower end. Pockets 55 can be formed of plastic material attached by heat sealing to the curtain. Positioned within each pocket 55 is a flexible hose 56 having a closed or crimoed lower end and containing a quantity of metal shot 57, or other finely divided heavy particles. The use of metal shot is an inexpensive manner of providing weight for the curtain and the quantity of shot can be readily adjusted to vary the weight as desired.

In addition to the weights along the bottom edge of each curtain, the free or moving vertical edge of each curtain 12 and 13 can also be weighted. This can be accomplished by attaching a tubular member or hose 58 to the vertical edge.

The lower end of the hose can be closed off or crimped, and shot 59 can be introduced into the hose 58 in an amount to provide the necessary weight for the vertical edge.

As previously noted, cable 14 is driven by a drive pulley 15 whigh is formed with a double groove. In addition, a tensioning pulley 60 carried by clevis 61 is positioned adjacent the drive pulley 15. Clevis 61 is mounted on the end of rod 62 whigh extends through one of the end plates 7, and a spring 63 is carried by rod 62 and is interposed between plate 7 and a nut 64 threa ed on the end of rod 42. Threading of the nut 64 will vary the force of spring 63 to correspondingly adjust the tension on cable 14.

Cable 14 is trained with two turns about the double grooved drive pulley 15 and a single turn over the tension pulley 60. The cable extends in a pair of horizontal parallel runs 65 and 66 between the drive pulley 15 and the idler pulleys 16 and 17, as shown in FIG. 2. Curtain 12 is supported on the forward run 65, while curtain 13 is supported from the rear run 66 of the cable.

The double groove drive pulley 15 increases the contact area between the drive pulley and cable 14 to provide more effective high speed movement of the curtain, yet the cable is capable of slipping on the pulley if the curtain, for some reason, is prevented from moving.

Drive pulley 15 is rotated by a motor 67 operating through worm gear drive 68 and the output shaft 69 of the worm gear drive is connected to pulley 15. Motor 67 and worm gear drive 66 are mounted or the upper frame 4.

As illustrated in FIG. 4, a flexible upper head curtain 70 can be attached to the upper surface of one of the beams 5 and extends downwardly through the upper portion of doorway 2. The lower edge of curtain 70 can be provided, if desired, with a weighted rope 71. The distance between the floor of the building and the lower edge of the head curtain 70 is normally designed to accommodate the usual type of load being transported through the doorway. In the event a load of greater height may occasionally pass through the doorway, the load will engage and deflect the head curtain to enable it to pass. The use of the head curtain 70 will act to reduce energy losses through the doorway, but will nevertheless deflect to accommodate an occasional load of greater height.

Figure 3:
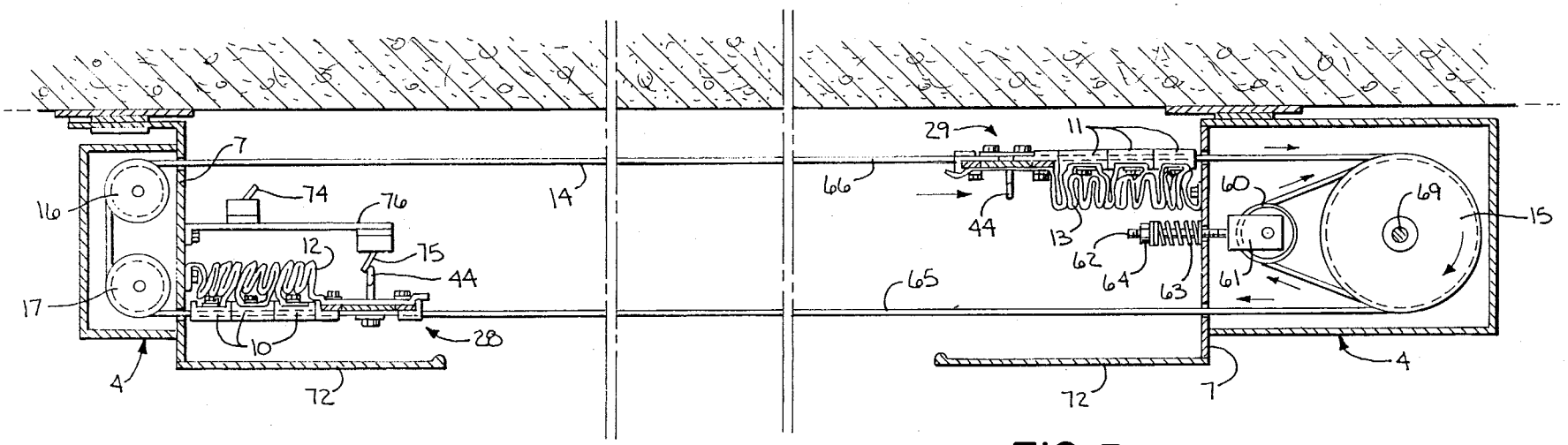
FIG. 3 is a view similar to FIG. 2 and showing the curtains in the open position.

To enclose each curtain 12 and 13 in its open folded condition, a generally L-shaped side enclosure 72 can be attached to building 3 adjacent each side of doorway 2. As best shown in FIG. 3, the enclosure 72 extends parallel to the building and encloses the curtain in the folded condition.

To control the opening and closing operation of the curtains, a pair of limit switches 74 and 75 are mounted on beam 76 whigh is secured between beams 5 at one end of frame 4. Limit switches 74 and 75 are adapted to be actuated by the arms 44 on the respective connectors 28 and 29. For example, when the curtains have moved to the closed position, arm 44 on connector 29 will engage limit switch 74 to terminate operation of motor 67. Similarly, when the curtains have moved to the full open position, the arm 44 on connector 28 will engage limit switch 75 to again stop operation of the motor.

As best shown in FIG. 1, each curtain can be provided with a transparent window 76, if desired.

Each curtain 12 and 13 is secured along one vertical side edge to the building and when in the closed position, the upper end of the opposite side edge will also be fixed in position, thus stretching each curtain diagonally. This opposite diagonal stretching of the two overlapping curtains will act to resist wind loads and minimize flapping of the curtains under pressure differentials or wind gust.

As the two curtains are in overlapping relation when in the closed position they provide an excellent weather seal. If the door is mounted on the outside of the building and there is a positive pressure differential from the inside of the building to the outside, meaning that the pressure on the inside is greater, the outer closed curtain 12 will seal against the side enclosures 72. Conversely, if there is a positive pressure from the outside in, the inner curtain 13 will seal against the building 3.

As the curtain is fabricated of lightweight materials, it can be operated with high speed between the open and closed positions. As a further advantage, the curtain door of the invention requires less space than either swinging doors or overhead doors.

If the curtains, when in the closed condition, are impacted by material handling equipment they will merely flex and will not fracture, nor will they cause damage to the equipment or personnel.

While the above description has shown the curtains 12 and 13, when in the closed condition extending completely across doorway 2, it is contemplated that in certain installations, each curtain may extend only partially across the doorway, with the curtains only being overlapped in the center of the doorway.

Figure 13:
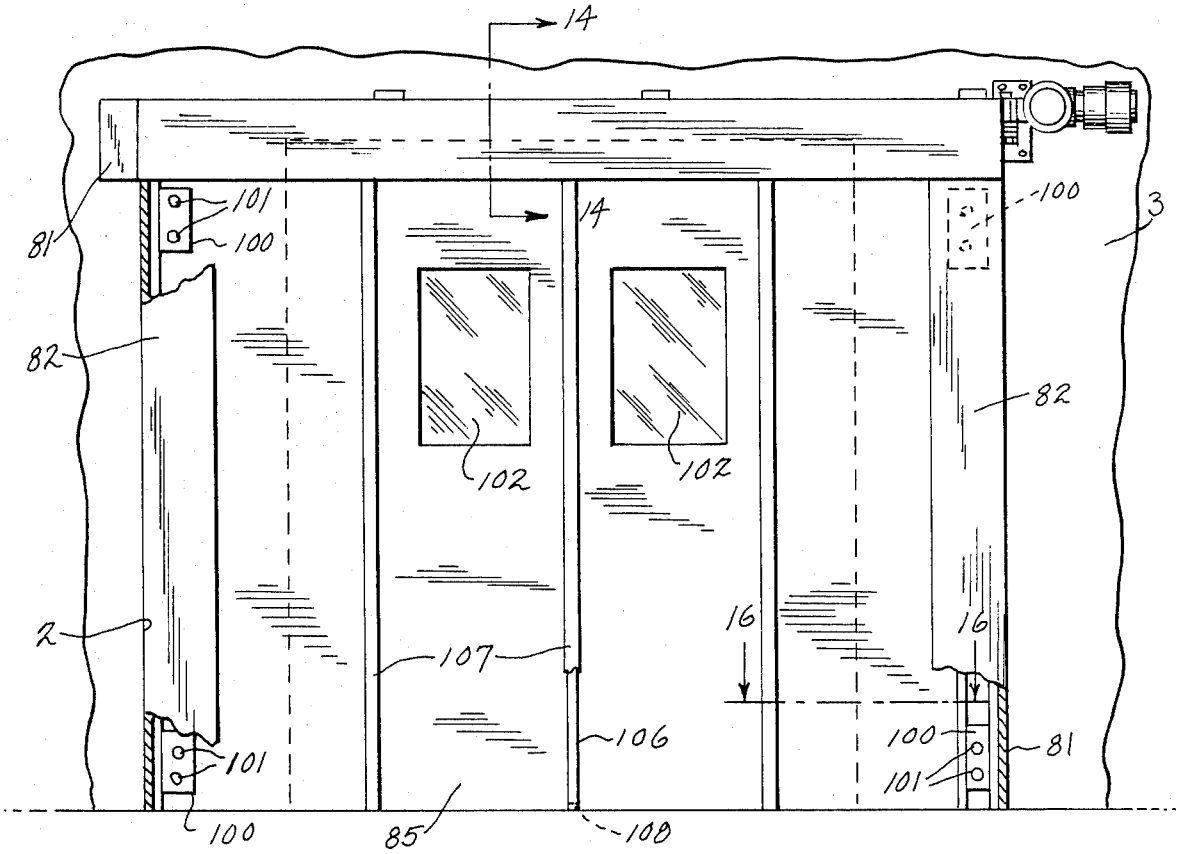
FIG. 13 is a front elevation of a modified form of the cutain door of the invention.

FIGS. 13–17 illustrate a modified form of the invention. In the embodiment of FIGS. 13–17, an extruded metal header 78, preferably formed of aluminum, is mounted to the building 3 above doorway 2 by a pair of clamping bars 79 and 80. As shown in FIG. 13, a pair of side members 81 are secured to the ends of the header 78 and extend downwardly along the sides of the doorway. In addition, a side closure 82 similar to closure 72 of the first embodiment, extends inwardly toward the center of the doorway from each side member.

Figure 14:
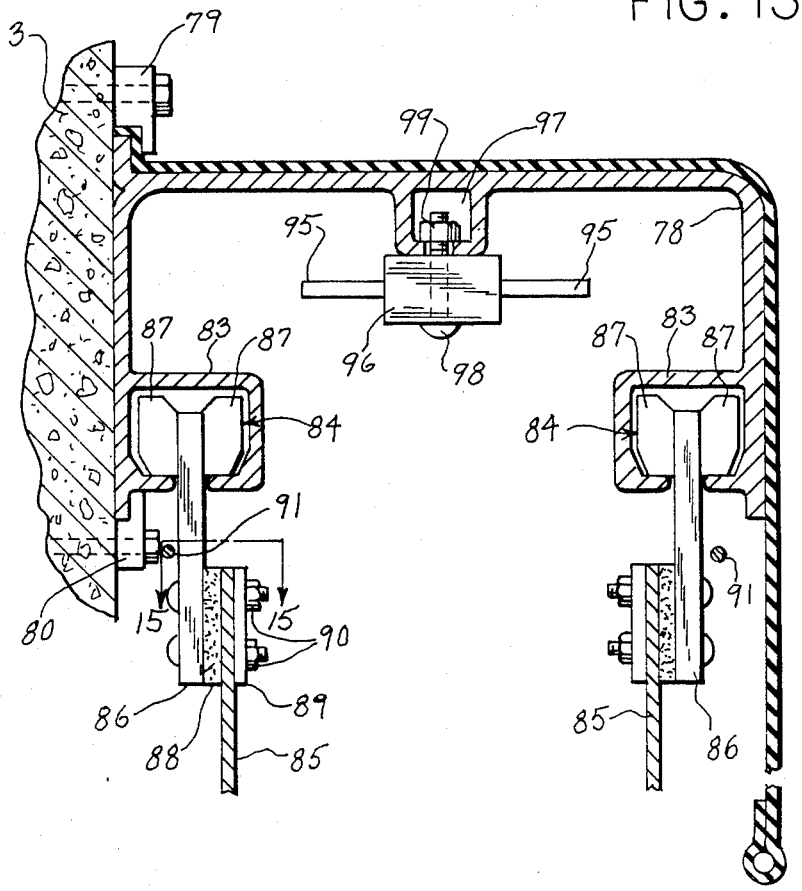
FIG. 14 is a vertical section of the header taken along line 14—14 of FIG. 13.

As illustrated in FIG. 14, header 78 defines a pair of spaced guide tracks 83 and a plurality of trolleys 84, similar to trolleys 10 of the first embodiment, are mounted for movement in guide tracks 83. A pair of curtains or panels 85, similar in construction to curtains 12, are carried by the trolleys 84 and movement of the trolleys 84 on guide tracks 83 will move the curtains 85 between an open and a closed position.

As best shown in FIGS. 14 and 15, each trolley 84 is composed of a generally vertical bar or strip 86 and a pair of gliders 87 are mounted on opposite faces of bar 86. Gliders 87 are formed of a material having a low coefficient of frictional resistance, such as high molecular weight polyethylene, and are adapted to ride in the respective guide tracks 83.

Positioned against the lower end of bar 86 is a compressible pad 88 formed of foam rubber, or the like. The upper edge of curtain 85 is clamped against the surface of pad 88 by a clamping bar 89 and clamping bar 89 is secured to the bar 86 by means of a pair of bolts 90.

As illustrated in FIG. 15, clamping bar 89 has a lesser width than vertical bar 86 and as a result, the central portion of pad 88 will be more thoroughly compressed than the edge portions, so that the curtain 85 will have a preformed contour or fold whigh will provide uniform folding of the curtain when the curtain is moved to the folded position. In addition, the side edges of pad 88 will tend to compress when the curtain is stretched out to its closed position, providing a cushion to prevent snap of the curtain on extending.

As described with respect to the first embodiment, a cable 91, similar in function to cable 14 of the first embodiment, is connected to connectors 93, whigh are similar in function and construction to connectors 28 and 29, previously described.

Movement of cable 91 in opposite directions will correspondingly move connectors 93 to pull the curtains 85 between the open and closed positions, and the trolleys 84 will slide on the tracks 83 as the curtains are folded and unfolded.

As illustrated in FIG. 17, a generally L-shaped rod 94 extends outwardly and upwardly from each connector 93 and serves to engage arm 95 of a limit switch 96 to control the opening and closing of curtains 85 in the manner previously described.

As best illustrated in FIGS. 14 and 17, limit switches 96 are mounted for adjustable movement within a central guide track 97 formed in header 78. A bolt 98 extends upwardly through aligned openings in limit switch 96 and track 97 and the upper end of the bolt receives a nut 99. By loosening the nut, each limit switch 96 can be moved longitudinally of guide track 97 to position the limit switch at the desired location.

One vertical side edge of each curtain 85 is secured to building 3 adjacent doorway 2. To provide this attachment, connecting plates 100 are attached by bolts 101 to the face of the building 3 along each side of the doorway. Bolts 101 extend through suitable eyes in the side edge of the respective curtain. With this connection, one vertical side edge of each curtain 85 is secured to building 3, while the opposite free vertical side edge is movable across the doorway 2 to the closed position through operation of cable 91.

As shown in FIG. 17, cable 91 is guided in movement on a pair of pulleys 103 and 104 whigh are journaled in end closure 81. A similar pair of pulleys, not shown, is located at the opposite end of header 78. The drive mechanism for operating cable 91 is the same as that previously described with respect to the first embodiment.

To increase the wind resistance of the curtains 85, a group of flexible vertical tubes 106 formed of plastic or the like, are attached in spaced relation to the surface of each curtain 85 through connecting strips 107. The side edges of each strip 107 can be attached to the curtain 85 by stitching, heat sealing, or other fastening means. The bottom of each tube 106 is closed off, as indicated in FIG. 13, by a plug or closure 108 and each tube is filled with a weight 109 whigh can take the form of lead shot. Tubes 106 extend the full height of the respective curtains 85, and one of the tubes is located along the free vertical edge of each curtain, as shown best in FIG. 16. Instead of using a separate strip 107 for attaching the tube to the curtain, the end tube 106 can be attached by wrapping the side edge of the tube around the tube 106, as indicated by 107*a* in FIG. 16.

In the closed position, as shown in FIG. 13, each curtain will be stretched diagonally across the doorway 2, with the lower triangular section of the curtain being freely swingable. Tubes 106 filled with the weighted material 109 act as battens to stiffen the lower triangular portion of each curtain and provide increased wind resistance to prevent deflection. By preventing deflection, the door is more capable of maintaining temperature differentials on opposite sides of the door. If the lower portions of curtains 85 are permitted to deflect under wind pressure a substantial gap can be produced adjacent the floor whigh will destroy the objective of separating environments. Deflection of the curtain can also encroach on floorspace to restrict movement of material handling equipment. As a further advantage, the tubes 106 create a more attractive appearance for the curtain door and will also aid in providing more uniform folding of the doors on opening.

Various modes of carrying out the invention are contemplated as being within the scope of the following claims particularly pointing out and distinctly claiming the subject matter whigh is regarded as the invention.

I claim:

1. An industrial door construction, comprising a building having a doorway, a pair of flexible curtains each having a first and second vertical side edge, means for securing the upper and lower ends of a first vertical side edge of each curtain to the building adjacent the side of the doorway, said curtains being movable between an open position where the curtains are folded along the respective sides of the doorway and a closed position where the curtain extends at least partially across said doorway in an overlapping condition, drive means for moving the curtains between the open and closed positions and including a drive member, trolley means to support an upper edge of each curtain from said drive member, said trolley means including a track disposed above the doorway and a plurality of trolleys mounted for movement on the track, said trolley means also including clamping means associated with each trolley to clamp a portion of the upper edge of the respective curtain, so that the curtain will be uniformly folded when moved to the open position, said clamping means includes a support member having an open-ended vertical recess, said curtain being disposed in said recess, said clamping means also including a clamping member to clamp said curtain in said recess to provide the clamped portion of the curtain with a generally U-shaped configuration in horizontal section.

2. The door construction of claim 1, wherein each trolley is provided with a horizontal opening to freely receive said drive member.

3. The door construction of claim 1, wherein each curtain has a horizontal width substantially equal to the width of said doorway whereby said curtains are in overlapped condition when in the closed condition.

4. The door construction of claim 1, wherein each curtain when closed is stretched diagonally along a line extending from a lower end of the first edge to the upper end of said second edge.

5. The door construction of claim 1, and including a side enclosure spaced outwardly from and parallel to said building, said side enclosures enclosing the respective curtains when in the open position.

6. The door construction of claim 5, wherein each curtain has a horizontal width at least equal to the width of said doorway, so that the curtains are in a fully overlapped condition when in the closed position, a pressure differential on opposite sides of said doorway causing one of said curtains to seal against said side enclosures.

7. An industrial door, comprising a supporting structure defining a doorway, a pair of flexible curtains, means for connecting the upper and lower ends of one vertical side edge of each curtain to the supporting structure adjacent a side of said doorway, a pair of guide tracks mounted on the supporting structure above said doorway, guide means connected to the upper edge of each curtain and movable in one of said guide tracks, drive means operably connected to said guide means for moving the curtains between a folded open condition wherein each curtain is folded adjacent the respective side of said doorway to a closed condition where the curtain extends at least partially across said doorway, each curtain when in the closed condition being stretched along a diagonal line extending from a lower end of said one side edge to an upper end of the opposite side edge, and a plurality of rigid generally vertical elongated stiffening members spaced along the length of each curtain, each stiffening member extending continuously from a lower edge of each curtain upwardly to a location above said diagonal line.

8. The dodor of claim 7, wherein each stiffening member includes a tube and a weight disposed within said tube.

9. The door of claim 8, wherein said weight comprises a multiplicity of metal shot.

10. The door of claim 7, wherein said stiffening members extend the full height of the curtain.

11. The door of claim 7, where at least one of said stiffening members is disposed along said opposite side edge of each curtain.

12. In combination, a structure having a doorway, a pair of flexible curtains each having first and second vertical side edges, means for securing the upper and lower end of a first vertical side edge of each curtain to the structure adjacent the side of the doorway, said curtains being movable between an open position where the curtains are folded along the respective sides of the doorway and a closed position where the curtains extend at least partially across said doorway in an overlapping condition, a cable, said cable disposed in first and second spaced parallel runs, connecting means for connecting the upper edge of each curtain to said cable, pulley means disposed at corresponding ends of said runs for guiding said cable between said runs, said pulley means at first corresponding ends of said runs comprising a double groove pulley and said pulley means at opposite corresponding ends of said runs comprising at least one single groove pulley, a separate idler pulley disposed adjacent said double grooved pulley, said cable extending from said first run to a first of said grooves of said double grooved pulley and then around said idler pulley and then extending in a second of said grooves of said double grooved pulley and then extending to said second run, and power operated drive means including a drive shaft operably connected to said double groove pulley.

13. The combination of claim 1, and including resilient tensioning means connected to said idler pulley.

14. The combination of claim 12, wherein said idler pulley is disposed between said first and second runs.

15. An industrial door construction, comprising a building have a doorway, a pair of flexible curtains each having a first and second vertical side edge, means for securing the upper and lower ends of a first vertical side edge of each curtain to the building adjacent the side of the doorway, said curtains being movable between an open position where the curtains are folded along the respective sides of the doorway and a closed position where the curtains extend at least partially cross said doorway in an overlapping condition, drive means for moving the curtains between the open and closed positions and including a drive member, trolley means to support an upper edge of the second vertical side edge of each curtain from said drive member, said trolley means including a track disposed above the doorway and a plurality of trolleys mounted for movement on the track, said trolley means also including clamping means associated with each trolley to clamp a portion of the upper edge of the respective curtain, said clamping means including a backing member, a resilient member having a pair of opposed surfaces, one of said surfaces disposed against said backing member, said curtain being disposed against the other of said surfaces, said clamping means also including a clamping member having a smaller horizontal dimension than said resilient member so that the side edge portions of said resilient member extend beyond said clamping member, and means for attaching said clamping member to said backing member and for compressing the central portion of said resilient member therebetween to deform said curtain to a generally U-shaped configuration.

16. The door construction of claim 15, wherein said resilient member is formed of foam plastic material.

* * * * *

UNITED STATES PATENT AND TRADEMARK OFFICE

CERTIFICATE OF CORRECTION

PATENT NO. : 4,770,224

DATED : September 13, 1988

INVENTOR(S) : VOLDEMAR DUBBELMAN

It is certified that error appears in the above-identified patent and that said Letters Patent is hereby corrected as shown below:

Title page:

Inventor at [75], delete "Voldeman" and substitute therefor ---Voldemar---; In the Claims, Col. 9, Line 38, CLAIM 8, delete "dodor" and substitute therefor ---door---.

Signed and Sealed this

Seventeenth Day of October, 1989

*Attest:*

*Attesting Officer*

DONALD J. QUIGG

*Commissioner of Patents and Trademarks*